US009851665B1

(12) United States Patent
Yokoyama

(10) Patent No.: US 9,851,665 B1
(45) Date of Patent: Dec. 26, 2017

(54) FIXATION DEVICE THAT HEATS A FIXATION BELT BY AN ELECTROMAGNETIC INDUCTION HEATING METHOD

(71) Applicants: KABUSHIKI KAISHA TOSHIBA, Tokyo (JP); TOSHIBA TEC KABUSHIKI KAISHA, Tokyo (JP)

(72) Inventor: Shuji Yokoyama, Shuntougun Nagaizumi Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/181,071

(22) Filed: Jun. 13, 2016

(30) Foreign Application Priority Data

Jul. 29, 2015 (JP) ..... 2015-150070

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2082; G03G 15/2042
See application file for complete search history.

(56) References Cited

U.S. PATENT DOCUMENTS

| | | | | |
|---|---|---|---|---|
| 9,250,583 | B1 * | 2/2016 | Himeno | G03G 15/2053 |
| 9,316,976 | B1 * | 4/2016 | Yokoyama | G03G 15/2053 |
| 2011/0076043 | A1 * | 3/2011 | Kikuchi | H05B 6/145 399/69 |
| 2011/0135359 | A1 * | 6/2011 | Kikuchi | G03G 15/2064 399/333 |
| 2015/0168888 | A1 * | 6/2015 | Kikuchi | G03G 15/2053 399/33 |
| 2015/0220031 | A1 * | 8/2015 | Kuribayashi | G03G 15/2089 399/329 |
| 2016/0116871 | A1 * | 4/2016 | Kikuchi | G03G 15/2053 399/329 |

FOREIGN PATENT DOCUMENTS

JP 3988251 B2 10/2007

* cited by examiner

*Primary Examiner* — Francis Gray
(74) *Attorney, Agent, or Firm* — Patterson & Sheridan, LLP

(57) ABSTRACT

According to an embodiment, a fixation device has a fixation belt, a coil, and a heat-generation auxiliary plate. The coil is opposed to the fixation belt and the heat-generation auxiliary plate and generates magnetic flux. The heat-generation auxiliary plate assists heating of a recording medium by the fixation belt. The heat-generation auxiliary plate has a magnetic layer and a non-magnetic layer formed on the magnetic layer and contacting a base layer of the fixation belt. The non-magnetic layer is harder than the base layer of the fixation belt.

19 Claims, 6 Drawing Sheets

FIXATION DEVICE THAT HEATS A FIXATION BELT BY AN ELECTROMAGNETIC INDUCTION HEATING METHOD

CROSS-REFERENCE TO RELATED APPLICATION

This application is based upon and claims the benefit of priority from the prior Japanese Patent Application No. 2015-150070, filed on Jul. 29, 2015, the entire contents of which are incorporated herein by reference.

FIELD

Embodiments described herein generally relate to a fixation device.

BACKGROUND

Conventionally, there are image formation apparatuses such as multi-function peripherals (hereinafter, referred to as "MFP") and printers. The image formation apparatus is provided with a fixation device. The fixation device heats an electrically-conductive layer of a fixation belt by an electromagnetic induction heating method (hereinafter, referred to as "IH method"). The fixation device fixes a toner image onto a recording medium by the heat of the fixation belt. The electrically-conductive layer of the fixation belt is caused to generate heat by induction currents. In order to shorten, for example, warming-up time of the fixation device, the fixation device uses the fixation belt having a small heat capacity. The fixation device includes a magnetic material in order to compensate for a deficient heat-generation quantity of the fixation belt. The magnetic material increases the heat-generation quantity of the fixation belt by concentrating magnetic flux in a case of electromagnetic-induction heating. For example, the magnetic material is a magnetic shunt alloy. The closer the magnetic material is to the fixation belt, the more easily the magnetic material can increase the heat-generation quantity of the fixation belt. The magnetic material is preferably in contact with the fixation belt. In a case where the magnetic material contacts the fixation belt, a layer (surface layer) is preferably provided on the surface of the magnetic material. The magnetic material requires a surface layer also for preventing corrosion of a base material. The surface layer of the magnetic material, which contacts the fixation belt, preferably has slidability, is hard to abrade, does not easily affect the electromagnetic-induction heating, and is not easily contaminated.

DETAILED DESCRIPTION

Figure 1:
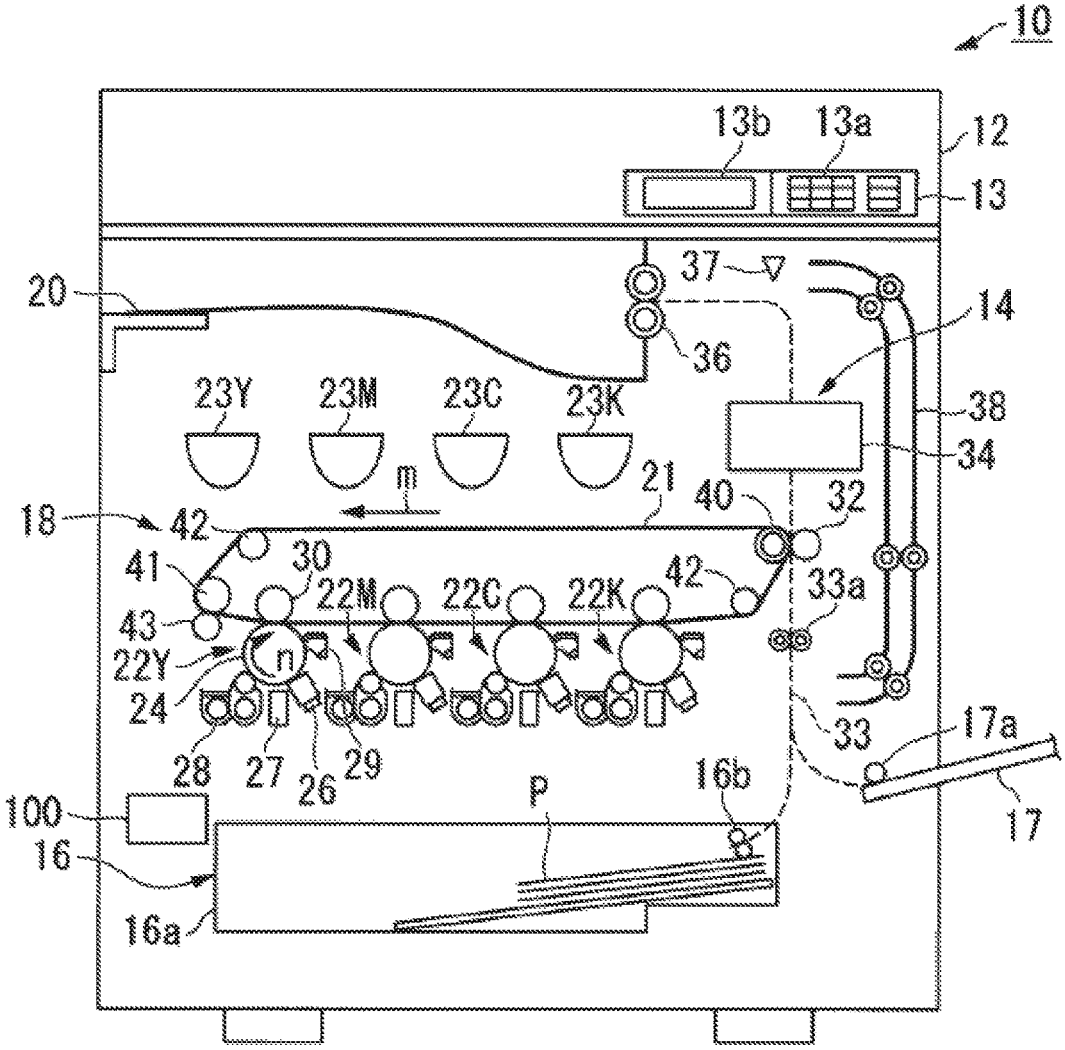
FIG. 1 is a cross-sectional view of an image formation apparatus including a fixation device according to an embodiment.

According to an embodiment, a fixation device has a fixation belt, a coil, and a heat-generation auxiliary plate. The fixation belt has a base layer and an electrically-conductive layer formed on the base layer. In order to fix a toner image on a recording medium, the fixation belt heats the toner image by causing the electrically-conductive layer to generate heat. The coil is opposed to the fixation belt and generates magnetic flux. The coil causes the electrically-conductive layer to generate heat by generating the magnetic flux. The heat-generation auxiliary plate has a magnetic layer, which contains a magnetic material and is opposed to the coil with the fixation belt interposed therebetween. The heat-generation auxiliary plate has a non-magnetic layer, which is formed on the magnetic layer and contains a non-magnetic material harder than the base layer of the fixation belt. The non-magnetic layer contacts the base layer of the fixation belt. The heat-generation auxiliary plate assists heating of the recording medium by the fixation belt.

Hereinafter, the embodiment will be further described with reference to the drawings. In the drawings, the same reference signs represent the same or similar parts.

FIG. 1 is a cross-sectional view of an image formation apparatus according to the embodiment. Hereinafter, an MFP 10 will be described as an example of the image formation apparatus. As shown in FIG. 1, the MFP 10 has a scanner 12, a control panel 13, and a main-body part 14. The scanner 12, the control panel 13, and the main-body part 14 have control units, respectively. The MFP 10 has a system control unit 100 as a control unit which controls the above-described control units. The system control unit 100 has a central processing unit (CPU) 100*a*, a read only memory (ROM) 100*b*, and a random access memory (RAM) 100*c* (see FIG. 4).

The system control unit 100 controls a main-body control circuit 101 (see FIG. 2), which is the control unit of the main-body part 14. The main-body control circuit 101 has a CPU, a ROM, and a RAM, which are not shown. The main-body part 14 has a paper-feeding cassette device 16, a printer device 18, a fixation device 34, etc. The main-body control circuit 101 controls the paper-feeding cassette device 16, the printer device 18, the fixation device 34, etc.

The scanner 12 scans an original copy and reads an original-copy image. The control panel 13 has input keys 13*a* and a display unit 13*b*. For example, the input keys 13*a* receive input by a user. For example, the display unit 13*b* is of a touch panel type. The display unit 13*b* receives the input by the user and displays information to the user.

The paper-feeding cassette device 16 has a paper-feeding cassette 16*a* and a pickup roller 16*b*. The paper-feeding cassette 16*a* houses sheets P, which are recording media. The pickup roller 16*b* takes out the sheets P from the paper-feeding cassette 16*a* and supplies the taken-out sheets P to a later-described conveyance path 33. Note that the sheets P housed in the paper-feeding cassette 16*a* are unused sheets. Therefore, the paper-feeding cassette device 16 supplies the unused sheets P to the conveyance path 33. Other than the above-described paper-feeding cassette device 16, the MFP 10 has a manual paper-feeding device as a device which supplies the unused sheets P to the conveyance path 33. The manual paper-feeding device has a paper-feeding tray 17 and a pickup roller 17*a*. The paper-feeding tray 17 retains unused sheets P placed thereon by the user. The pickup roller 17*a* supplies the unused sheets P, which are retained by the paper-feeding tray 17, to the conveyance path 33.

The printer device 18 forms an image. For example, the printer device 18 forms an image of the original-copy image read by the scanner 12. The printer device 18 has an intermediate transfer belt 21. The printer device 18 supports the intermediate transfer belt 21 by using a backup roller 40, a driven roller 41, and tension rollers 42. The printer device 18 has a drive part (not shown) for rotating the backup roller 40. The printer device 18 subjects the intermediate transfer belt 21 to endless travelling in the direction of an arrow m by rotating the backup roller 40.

The printer device 18 has four sets of image formation stations 22Y, 22M, 22C, and 22K. The image formation stations 22Y, 22M, 22C, and 22K operate for forming the images of the colors of Y (yellow), M (magenta), C (cyan), and K (black), respectively. The image formation stations 22Y, 22M, 22C, and 22K are disposed on the lower side of the intermediate transfer belt 21 and in parallel along the travelling direction of the intermediate transfer belt 21.

The printer device 18 has cartridges 23Y, 23M, 23C, and 23K above the image formation stations 22Y, 22M, 22C, and 22K. The cartridges 23Y, 23M, 23C, and 23K house refilling toner of the colors of Y (yellow), M (magenta), C (cyan), and K (black), respectively.

Hereinafter, among the image formation stations 22Y, 22M, 22C, and 22K, the image formation station 22Y will be described as an example. Note that detailed descriptions of the image formation stations 22M, 22C, and 22K will be omitted since they have similar configurations as the image formation station 22Y.

The image formation station 22Y has a photoreceptor drum 24 as an image carrier, an electrification charger 26, an exposure scanning head 27, a developing device 28, and a photoreceptor cleaner 29. The electrification charger 26, the exposure scanning head 27, the developing device 28, and the photoreceptor cleaner 29 are disposed around the photoreceptor drum 24, which rotates in the direction of an arrow n.

The image formation station 22Y has a primary transfer roller 30. The primary transfer roller 30 is opposed to the photoreceptor drum 24 via the intermediate transfer belt 21. The image formation station 22Y electrifies the photoreceptor drum 24 by the electrification charger 26 and then exposes the photoreceptor drum 24 by the exposure scanning head 27. The image formation station 22Y forms an electrostatic latent image on the photoreceptor drum 24 by exposing the photoreceptor drum 24. The developing device 28 develops the electrostatic latent image on the photoreceptor drum 24 by using, for example, a two-component developing agent formed of the toner of Y and a carrier. The developing device 28 forms a Y-color toner image on the photoreceptor drum 24 by developing the electrostatic latent image.

The primary transfer roller 30 subjects the toner image, which is formed on the photoreceptor drum 24, to primary transfer onto the intermediate transfer belt 21. The image formation stations 22Y, 22M, 22C, and 22K form a color toner image on the intermediate transfer belt 21 by the primary transfer roller 30. The color toner image is formed by sequentially overlapping and transferring the toner images of Y (yellow), M (magenta), C (cyan), and K (black). The photoreceptor cleaner 29 removes, from the photoreceptor drum 24, the toner remaining on the photoreceptor drum 24 after the primary transfer.

The printer device 18 has a secondary transfer roller 32. The secondary transfer roller 32 is opposed to the backup roller 40 via the intermediate transfer belt 21. The secondary transfer roller 32 collectively subjects the color toner image, which is on the intermediate transfer belt 21, to secondary transfer onto the sheet P. The sheet P is supplied from the paper-feeding cassette device 16 or the paper-feeding tray 17 to the conveyance path 33 and conveyed, via this conveyance path 33, to the position where the secondary transfer roller 32 and the backup roller 40 are opposed to each other.

The printer device 18 has a belt cleaner 43 opposed to the driven roller 41 via the intermediate transfer belt 21. The belt cleaner 43 removes the toner remaining on the intermediate transfer belt 21 after the secondary transfer.

The printer device 18 has a registration roller 33*a*, the fixation device 34, and a paper-discharge roller 36 along the conveyance path 33. Furthermore, the printer device 18 has a paper-discharge tray 20, a branching unit 37, and an inverting conveyance unit 38 in the downstream of the fixation device 34. The branching unit 37 sends the sheet P, which has undergone fixation, to the paper-discharge tray 20 or the inverting conveyance unit 38. In a case of both-side printing in which images are formed on both sides of the sheet P, the inverting conveyance unit 38 inverts the front/back of the sheet P sent from the branching unit 37. The inverting conveyance unit 38 reconveys the inverted sheet P to a position in the downstream of the registration roller 33*a* in the conveyance path. The MFP 10 transfers the toner image to the sheet P by using the printer device 18 and then fixes the toner image onto the sheet P by using the fixation device 34. The MFP 10 discharges the sheet P, on which the toner image has been fixed, to the paper-discharge tray 20. Note that the MFP 10 is not limited to a tandem-type image formation apparatus in which multiple image formation stations are disposed in parallel along the intermediate transfer belt 21. The number of the image formation stations is also not limited. Also, the MFP 10 may directly transfer the toner image from the photoreceptor drum 24 to the sheet P.

Figure 2:
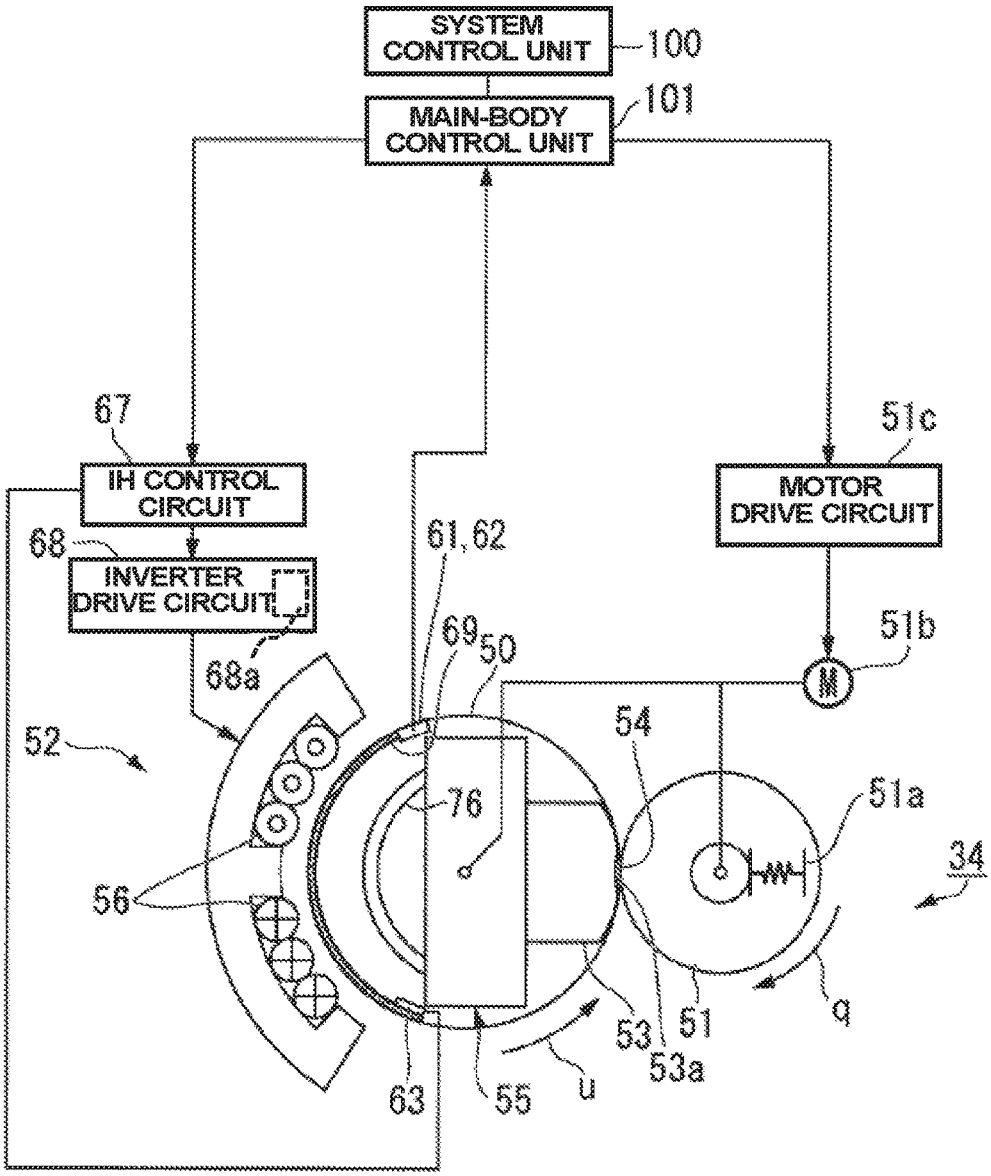
FIG. 2 is a view showing the fixation device according to the embodiment.

Hereinafter, the fixation device 34 will be described in detail. FIG. 2 is a view describing a control configuration of an electromagnetic-induction-heating coil unit 52 (induction current generating unit) and the main-body control circuit 101 (control unit) of the fixation device 34 according to the embodiment. As shown in FIG. 2, the fixation device 34 has the electromagnetic-induction-heating coil unit 52 and the main-body control circuit 101. Hereinafter, the electromagnetic-induction-heating coin unit will be referred to as "IH coil unit". Furthermore, the fixation device 34 has a fixation belt 50, a press roller 51, and a heat-generation auxiliary plate 69. The fixation belt 50 is a tubular endless belt. A belt internal mechanism 55 is disposed in the inner peripheral side of the fixation belt 50. The belt internal mechanism 55 includes a nip pad 53 and the heat-generation auxiliary plate 69. Note that, in the present embodiment, the fixation belt 50 and the heat-generation auxiliary plate 69 contact each other.

Figure 5:
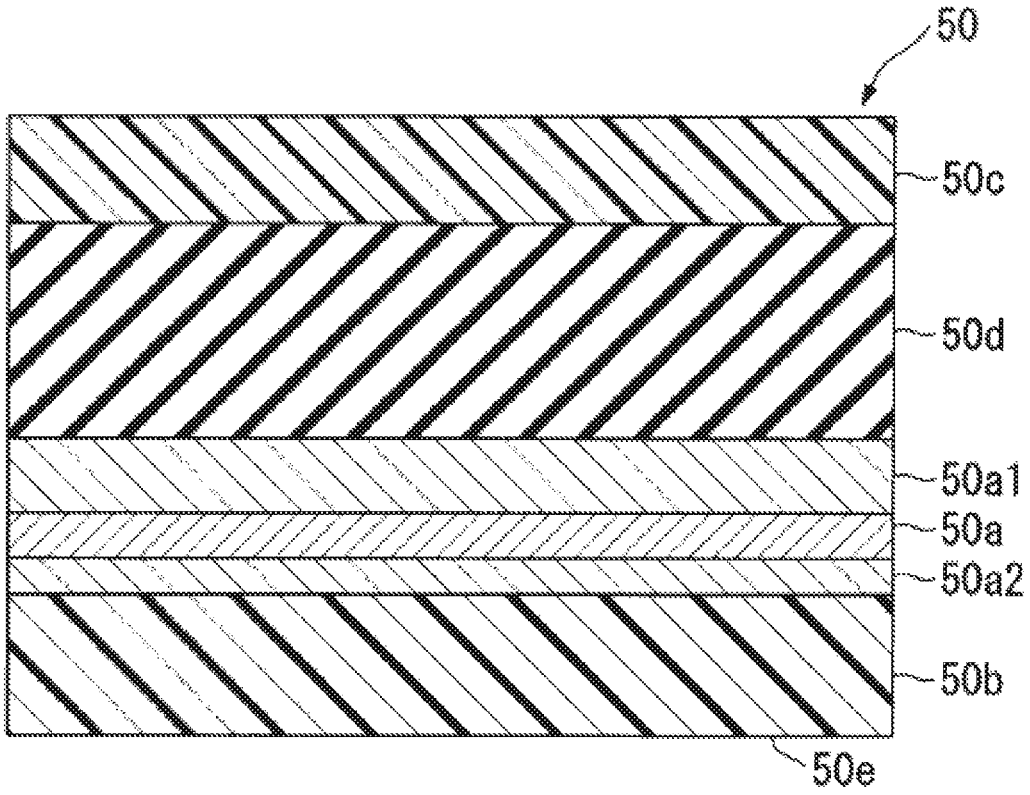
FIG. 5 is a cross-sectional view of the fixation belt of the fixation device according to the embodiment.

As shown in FIG. 5, the fixation belt 50 is formed by sequentially stacking a heat generating layer 50*a* (electrically-conductive layer) as a heat generating part, a cushion layer 50*d*, a releasing layer 50*c*, etc. on a base layer 50*b*. For example, the base layer 50*b* is formed of a polyimide resin (PI). For example, the heat generating layer 50*a* is formed of a non-magnetic metal such as copper (Cu). For example, the cushion layer 50*d* is formed of solid rubber such as silicon rubber. For example, the releasing layer 50*c* is formed of a fluorine resin such as tetrafluoroethylene perfluoro alkyl vinyl ether copolymer resin (PFA).

In order to reduce the heat capacity of the fixation belt 50, the thickness of the copper layer of the heat generating layer 50*a* of the fixation belt 50 is 10 μm. For example, the heat generating layer 50*a* is sandwiched between protective layers 50*a*1 and 50*a*2 of, for example, nickel. The protective layers 50*a*1 and 50*a*2 cover the front/back surfaces of the heat generating layer 50*a* and suppress oxidation of the copper layer. For example, the thickness of the base layer 50*b* is 70 μm. For example, the base layer 50*b* may be formed of non-magnetic stainless steel (SUS) instead of the polyimide resin.

In order to enable the fixation device 34 to carry out rapid warming up, the heat generating layer 50*a* of the fixation belt 50 is a thin layer having a small heat capacity since the fixation belt 50 carries out rapid warming up. The fixation belt 50 having a small heat capacity shortens the time required for warming up and saves consumed energy.

Note that, the protective layer 50*a*2 may be formed by non-electrolytic nickel plating on the base layer 50*b* formed of a polyimide resin, and the heat generating layer 50*a* may be formed by electrolytic copper plating while using the protective layer 50*a*2 as a binder layer. As a result of carrying out the non-electrolytic nickel plating, the adhesion strength between the base layer 50*b* and the heat generating layer 50*a* is improved. The protective layer 50*a*1 may be further formed by electrolytic nickel on the heat generating layer 50*a*.

Meanwhile, the surface of the base layer 50*b* may be roughened by sandblast or chemical etching. As a result of roughening the surface of the base layer 50*b*, the adhesion strength between the base layer 50*b* and the nickel plating of the heat generating layer 50*a* is mechanically further improved.

Moreover, metal such as titanium (Ti) may be dispersed in the polyimide resin, which forms the base layer 50*b*. As a result of dispersing the metal in the base layer 50*b*, the adhesion strength between the base layer 50*b* and the nickel plating of the heat generating layer 50*a* is further improved.

For example, the heat generating layer 50*a* may be formed of nickel, iron (Fe), stainless steel, aluminum (Al), and silver (Ag). The heat generating layer 50*a* may be formed by using alloys of two or more types or may be formed by overlapping metals of two or more types like layers.

As shown in FIG. 2, the IH coil unit 52 has main coils 56. High-frequency currents are applied to the main coils 56 from an inverter drive circuit 68. When the high-frequency currents flow to the main coils 56, high-frequency magnetic fields are generated around the main coils 56. The magnetic flux of the above-described high-frequency magnetic fields generate eddy currents at the heat generating layer 50*a* of the fixation belt 50. The above-described eddy currents and the electric resistance of the heat generating layer 50*a* generate Joule heat in the heat generating layer 50*a*. The generation of the above-described Joule heat heats the fixation belt 50.

The heat-generation auxiliary plate 69 is disposed on the inner peripheral side of the fixation belt 50. When viewed from the width direction of the fixation belt 50, the heat-generation auxiliary plate 69 is formed in a circular-arc shape along the inner peripheral surface of the fixation belt 50. The heat-generation auxiliary plate 69 is opposed to the main coils 56 with the fixation belt 50 interposed therebetween.

An auxiliary-plate main body 69*c* (magnetic material, see FIG. 6) of the heat-generation auxiliary plate 69 is a magnetic shunt alloy (ferromagnet) having a Curie point lower than that of the heat generating layer 50*a*. Magnetic flux is generated between the main coils 56 and the fixation belt 50 by the magnetic flux generated by the main coils 56. The magnetic flux generated by the main coils 56 generates magnetic flux also between the heat-generation auxiliary plate 69 and the fixation belt 50. The generation of the above-described magnetic flux heats the fixation belt 50. A surface layer (non-magnetic layer 69*b*), which contacts the fixation belt 50, is formed on the outer peripheral side (the side of the fixation belt 50) of the auxiliary-plate main body 69*c*. This surface layer will be described later.

Since the heat-generation auxiliary plate 69 is supported by the belt internal mechanism 55, the outer surface of the heat-generation auxiliary plate 69 in the radial direction contacts the inner peripheral surface of the fixation belt 50. Specifically, in the belt internal mechanism 55, circular-arc-shaped both ends of the heat-generation auxiliary plate 69 are elastically supported by bases (not shown). As a result, the heat-generation auxiliary plate 69 is pressed against the fixation belt 50. Therefore, the heat-generation auxiliary plate 69 contacts the inner peripheral surface of the fixation belt 50. Note that, depending on the belt internal mechanism 55, the heat-generation auxiliary plate 69 may be close to and separated from the fixation belt 50. For example, upon warming-up of the fixation device 34, the belt internal mechanism 55 may cause the outer surface of the heat-generation auxiliary plate 69 in the radial direction to be separated from the inner peripheral surface of the fixation belt 50.

Moreover, the length of the heat-generation auxiliary plate 69 in the width direction of the fixation belt 50 is larger than the length of the paper-passing region in the width direction of the fixation belt 50 (hereinafter, referred to as "sheet width"). Note that the width of the sheet P is the width of the sheet P having the largest short-side width among the sheets P used. For example, the width of the sheet P is a width somewhat larger than the short-side width of the paper of an A3 size.

Figure 3:
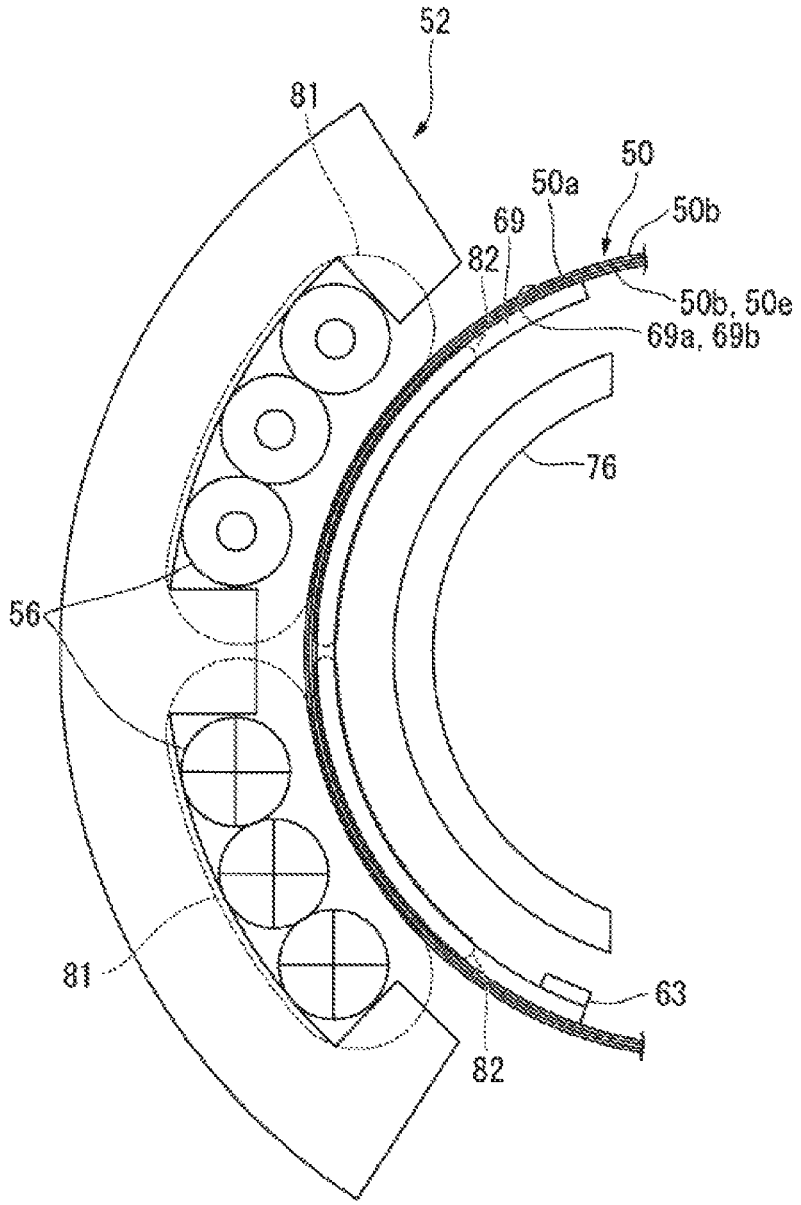
FIG. 3 is a view describing magnetic paths to a fixation belt and a heat-generation auxiliary plate caused by the magnetic flux of an IH coil unit of the fixation device according to the embodiment.

FIG. 3 is a view describing magnetic paths between the main coils 56 and the fixation belt 50 as well as the heat-generation auxiliary plate 69 according to the embodiment. As shown in FIG. 3, the magnetic flux generated by the main coils 56 forms first magnetic paths 81 induced to the heat generating layer 50*a* of the fixation belt 50. The first magnetic paths 81 pass through the cores of the main coils 56 and the heat generating layer 50*a* of the fixation belt 50. The magnetic flux generated by the main coils 56 forms second magnetic paths 82 induced to the heat-generation auxiliary plate 69. The second magnetic paths 82 are formed at the positions adjacent to the first magnetic paths 81 in the radial direction of the fixation belt 50 (hereinafter, referred to as "belt radial direction"). The second magnetic paths 82 pass through the heat-generation auxiliary plate 69 and the heat generating layer 50*a*.

The heat-generation auxiliary plate 69 (auxiliary-plate main body 69*c*) is formed of a thin metal member made of a magnetic shunt alloy such as iron or nickel alloy having a Curie point of 220° C. to 230° C. If the temperature of the heat-generation auxiliary plate 69 exceeds the Curie point, the heat-generation auxiliary plate 69 is changed from ferromagnetism to paramagnetism. Therefore, if the temperature of the heat-generation auxiliary plate 69 exceeds the Curie point, the second magnetic paths 82 are not formed, and the heat-generation auxiliary plate 69 no longer assists heating of the fixation belt 50. When the heat-generation auxiliary plate 69 is formed of the magnetic shunt alloy, the heat-generation auxiliary plate 69 assists the temperature increase of the fixation belt 50 if the temperature thereof is lower than the Curie point. The heat-generation auxiliary plate 69 can suppress excessive temperature increase of the fixation belt 50 if the temperature thereof is higher than the Curie point.

Note that the heat-generation auxiliary plate 69 may be formed of a thin metal member having a magnetic characteristic such as iron, nickel, and stainless steel. The heat-generation auxiliary plate 69 may be formed of, for example, a resin containing magnetic powder as long as it has a magnetic characteristic. The heat-generation auxiliary plate 69 may be formed of a magnetic material (ferrite). The heat-generation auxiliary plate 69 is not limited to a thin-plate member.

As shown in FIG. 2, a shield 76 is disposed on the inner peripheral side of the heat-generation auxiliary plate 69. The shield 76 is formed in a circular-arc shape similar to the heat-generation auxiliary plate 69. The both ends of the circular-arc shape of the shield 76 are supported by bases (not shown). The shield 76 may support the heat-generation auxiliary plate 69. For example, the shield 76 is formed of a non-magnetic material such as aluminum and copper. The shield 76 shields the magnetic flux from the IH coil unit 52.

On the inner peripheral side of the fixation belt 50, the nip pad 53 presses the inner peripheral surface of the fixation belt 50 toward the press roller 51. A nip 54 is formed between the fixation belt 50 and the press roller 51. The nip pad 53 has a nip formation surface 53*a*, which forms the nip 54 between the fixation belt 50 and the press roller 51. The nip formation surface 53*a* is curved so as to form a convex shape on the inner peripheral side of the fixation belt 50 when viewed from the belt-width direction. The nip formation surface 53*a* is curved so as to follow the outer peripheral surface of the press roller 51 when viewed from the belt-width direction.

For example, the nip pad 53 is formed of an elastic material such as silicon rubber and fluoro-rubber. The nip pad 53 may be formed of a heat resistant resin such as a polyimide resin (PI), a polyphenylene sulfide resin (PPS), a polyether sulfone resin (PES), liquid crystal polymer (LCP), and a phenol resin (PF).

For example, a sheet-shaped friction reducing member is disposed between the fixation belt 50 and the nip pad 53. For example, the friction reducing member is formed of, for example, a sheet member having good slidability and excellent abrasion resistance and a releasing layer. The friction reducing member is fixedly supported by the belt internal mechanism 55. The friction reducing member is brought into slidable contact with the inner peripheral surface of the travelling fixation belt 50. The friction reducing member may be formed of the following sheet member having lubricity. For example, the above-described sheet member may be a glass fiber sheet impregnated with a fluorine resin.

For example, the press roller 51 has, for example, a heat-resistant silicon-sponge and silicon-rubber layer around a core metal. For example, a releasing layer is disposed on the surface of the press roller 51. The releasing layer is formed of a fluorine-based resin such as a PFA resin. The press roller 51 pressurizes the fixation belt 50 by a pressurizing mechanism 51*a*.

The MFP 10 has one motor 51*b* as a drive source of the fixation belt 50 and the press roller 51. The motor 51*b* is driven by a motor drive circuit 51*c*, which is controlled by the main-body control circuit 101. The motor 51*b* is connected to the press roller 51 via a first gear row (not shown). The motor 51*b* is connected to a belt drive member via a second gear row and a one-way clutch (none of them are shown). The press roller 51 is rotated in the direction of an arrow q by the motor 51*b*. When the fixation belt 50 and the press roller 51 abut each other, the fixation belt 50 is driven by the press roller 51 and rotates in the direction of an arrow u. When the fixation belt 50 and the press roller 51 are separated from each other, the fixation belt 50 is rotated in the direction of the arrow u by the motor 51*b*. The fixation belt 50 may be driven by a drive source which is independent from the drive source of the press roller 51.

A center thermistor 61 and an edge thermistor 62 are disposed on the inner peripheral side of the fixation belt 50. The center thermistor 61 and the edge thermistor 62 measure belt temperatures. The measurement results of the belt temperatures are input to the main-body control circuit 101. The center thermistor 61 is disposed on the inner side in the belt width direction. The edge thermistor 62 is disposed in a heating region and a paper-non-passing region of the IH coil unit 52 in the belt width direction. If the belt temperature measured by the edge thermistor 62 is equal to or higher than a threshold value, the main-body control circuit 101 stops the output for electromagnetic induction heating. When the paper-non-passing region of the fixation belt 50 has an excessively increased temperature, the fixation belt 50 is prevented from being damaged by stopping the output for the electromagnetic induction heating.

Specifically, the main-body control circuit 101 controls an IH control circuit 67 in accordance with the measurement results of the belt temperatures of the center thermistor 61 and the edge thermistor 62. The main-body control circuit 101 controls the IH control circuit 67 to control the magnitude of the high-frequency current output by the inverter drive circuit 68. The fixation belt 50 retains various control temperature ranges depending on the output of the inverter drive circuit 68. The IH control circuit 67 has a CPU, a ROM, and a RAM, which are not shown.

Moreover, for example, a thermostat 63 is disposed in the belt internal mechanism 55. The thermostat 63 functions as a safety device of the fixation device 34. The thermostat 63 is actuated when the fixation belt 50 abnormally generates heat and increases the temperature thereof to an interruption threshold value. The actuation of the thermostat 63 interrupts the current to the IH coil unit 52. The fixation device 34 is prevented from abnormal heat generation by interrupting the current to the IH coil unit 52.

Figure 4:
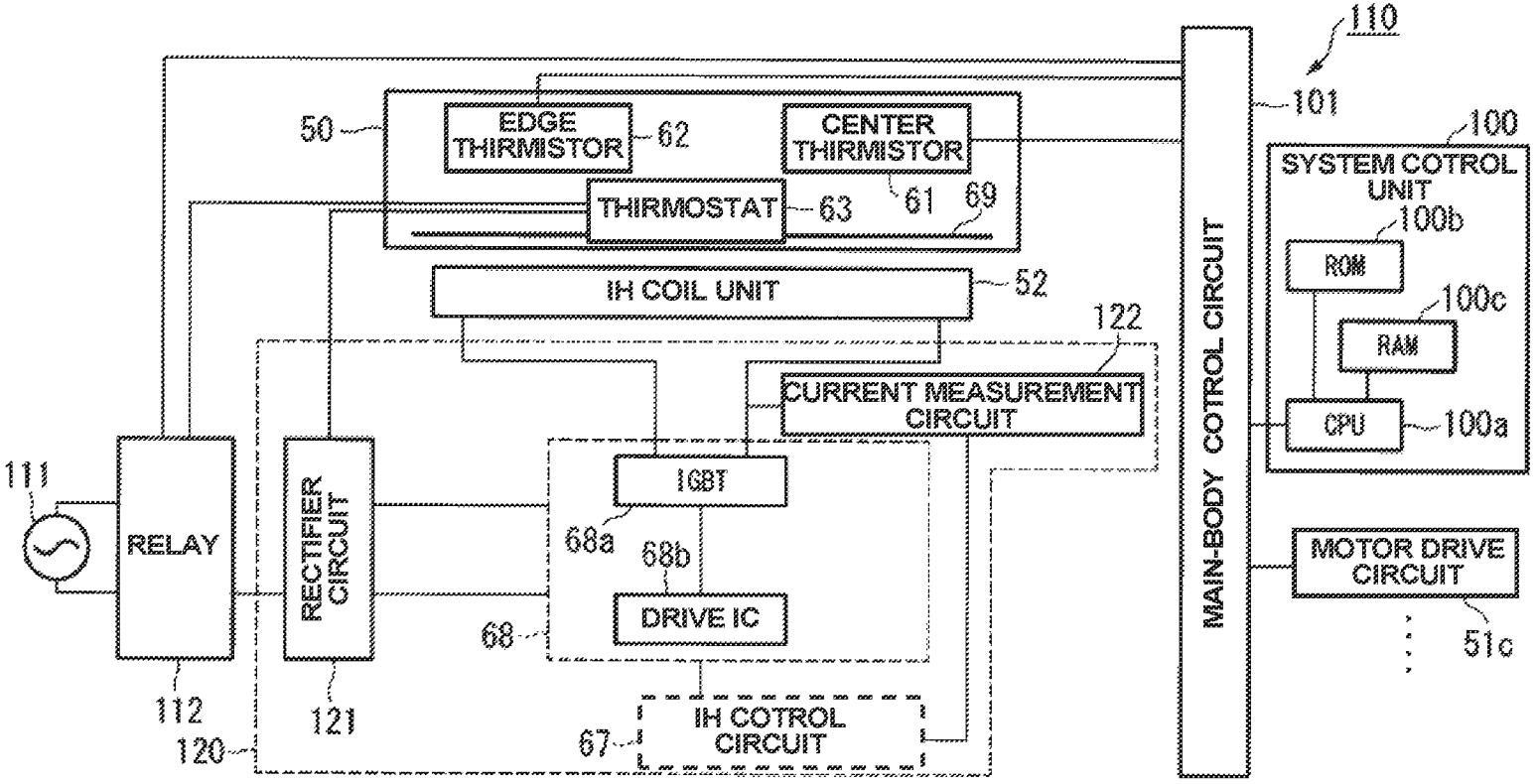
FIG. 4 is a block diagram showing a control system which mainly controls the IH coil unit of the fixation device according to the embodiment.

FIG. 4 is a block diagram showing a control system 110 of the IH coil unit 52 according to the embodiment. As shown in FIG. 4, the control system 110 has the system control unit 100, the main-body control circuit 101, an IH circuit 120, and the motor drive circuit 51*c*. The control system 110 supplies electric power to the IH coil unit 52 by the IH circuit 120. The IH circuit 120 has a rectifier circuit 121, the IH control circuit 67, the inverter drive circuit 68, and a current measurement circuit 122.

A current is input to the IH circuit 120 from an alternating-current source 111 via a relay 112. The IH circuit 120 rectifies the input current by the rectifier circuit 121 and supplies that to the inverter drive circuit 68. If the thermostat 63 is off, the relay 112 interrupts the current from the alternating-current source 111. The inverter drive circuit 68 has a drive integrated circuit (IC) 68*b* of an insulated gate bipolar transistor (IGBT) element 68*a*. The IH control circuit 67 controls the drive IC 68*b* in accordance with the measurement results of the belt temperatures by the center thermistor 61 and the edge thermistor 62. The IH control circuit 67 controls the drive IC 68*b* to control the output of the IGBT element 68*a*. The current measurement circuit 122 transmits the measurement results of the output of the IGBT element 68*a* to the IH control circuit 67. Based on the measurement results of the output of the IGBT element 68*a* by the current measurement circuit 122, the IH control circuit 67 controls the drive IC 68*b* so that the output of the IH coil unit 52 becomes constant.

Figure 6:
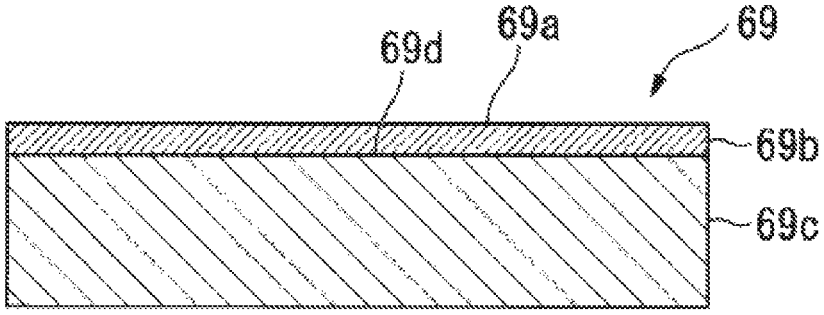
FIG. 6 is a cross-sectional view of the heat-generation auxiliary plate of the fixation device according to the embodiment.

As shown in FIGS. 3 and 6, an outer peripheral surface (contact surface) 69*a* of the heat-generation auxiliary plate 69, which contacts the fixation belt 50, is formed of a layer (surface layer) containing tin (Sn) as a main component. The surface layer (surface coat) of the present embodiment is formed of tin plating. For example, the surface layer is formed by in-solution plating. The surface layer improves the low frictional property, abrasion resistance, thin-film formability, etc. of the outer peripheral surface 69*a* of the heat-generation auxiliary plate 69. The tin plating is not limited to a pure metal, but may be a tin alloy to increase hardness.

As shown in FIGS. 3 and 5, the fixation belt 50 has the heat generating layer 50*a* and the base layer 50*b*. The material of the heat generating layer 50*a* of the fixation belt 50 is copper. The material of the base layer 50*b* of the fixation belt 50 is polyimide. The base layer 50*b* is brought into slidable contact with the outer peripheral surface 69*a* of the heat-generation auxiliary plate 69. Therefore, the base layer 50*b* forms an inner peripheral surface 50*e*, which contacts the outer peripheral surface 69*a* of the heat-generation auxiliary plate 69. The surface layer of the heat-generation auxiliary plate 69 is harder than the base layer 50*b* (polyimide layer), which forms the inner peripheral surface 50*e* of the fixation belt 50. By causing the tin plating, which is the surface layer, to be harder than the base layer 50*b*, abrasion of the tin plating by frictions is prevented.

Moreover, in the present embodiment, lubricant oil such as silicon oil is applied to the inner peripheral surface 50*e* of the fixation belt 50. By virtue of this lubricant oil, the friction resistance of the sliding contact between the fixation belt 50 and the heat-generation auxiliary plate 69 is not easily affected by the differences caused by the material properties of the inner peripheral surface 50*e* of the fixation belt 50 and the outer peripheral surface 69*a* of the heat-generation auxiliary plate 69. However, even when the lubricant oil is applied in the above-described manner, since the members contact each other, the base layer 50*b* of the fixation belt 50 is scrapped off, and abrasion powder is generated. Particularly, the abrasion powder is generated when the nip pad 53, which is pressurized to carry out fixation onto the sheet P, scrapes off the base layer 50*b* of the fixation belt 50. Though not as much as that by the nip pad 53, abrasion powder is also generated by scraping off the base layer 50*b* by the heat-generation auxiliary plate 69. When the abrasion powder is generated, this abrasion powder is mixed with the silicon oil, becomes like paste, adheres to the fixation belt 50 and the heat-generation auxiliary plate 69, and becomes contaminations. These contaminations enter the gaps, for example, between the heat-generation auxiliary plate 69 and the fixation belt 50 and between the nip pad 53 and the fixation belt 50 and retard the rotations of the fixation belt 50. Moreover, the above-described contaminations adhere also to sensors. The retardation of the rotations of the fixation belt 50 causes load increase of the motor 51*b*, breakage of the fixation belt 50, etc. If the above-described contaminations adhere to the sensors, control of the apparatus is affected. All of these are causes of failure, which leads to short life of the apparatus. However, when tin is used in the surface layer of the heat-generation auxiliary plate 69, the contaminations do not easily adhere to the surface layer, and the causes of failure can be reduced.

The surface layer of the heat-generation auxiliary plate 69 is the non-magnetic layer 69*b*. The non-magnetic layer 69*b* does not contain a magnetic material such as nickel (Ni). The non-magnetic layer 69*b* prevents corrosion of the auxiliary-plate main body 69*c*, which is a base material, and at the same time, is not affected by the heat generation of the heat generating layer 50*a* by the IH coil unit 52. For example, if the surface layer of the heat-generation auxiliary plate 69 contains nickel, nickel causes excessive heat generation of the heat generating layer 50*a*. More specifically, since the Curie point of nickel (627 degrees) is higher than the Curie point of the heat-generation auxiliary plate 69 (magnetic shunt alloy), even after the magnetic shunt alloy reaches the Curie point and the magnetic paths are lost, magnetic paths are formed between nickel and the heat generating layer 50*a* (electrically-conductive layer), and heat generation of the heat generating layer 50*a* is assisted by nickel. This is particularly notable when the nickel layer is thick. Therefore, the temperature of the fixation belt 50 continues to increase, a measure such as stopping the IH coil unit 52 is required, and heat-generation efficiency is deteriorated. On the other hand, the non-magnetic layer 69*b* does not form magnetic paths between the non-magnetic layer 69*b* and the electrically-conductive layer and, therefore, does not easily affect heat generation of the heat generating layer 50*a* (electrically-conductive layer).

However, if the surface layer (non-magnetic layer 69*b*) has a large thickness, the distance between the heat generating layer 50*a* of the fixation belt 50 and the auxiliary-plate main body 69*c* of the heat-generation auxiliary plate 69 is increased, and heat-generation efficiency is deteriorated. Therefore, the thickness of the surface layer is preferably 1 μm or less. Moreover, if the film thickness of the surface layer (non-magnetic layer 69*b*) is thick, the plating may deform the base material (heat-generation auxiliary plate 69) by thermal contraction after film formation. If the base material is thin, attention is particularly required.

Note that, if a nickel layer is provided as a binder layer between the auxiliary-plate main body 69*c* and the surface layer, the thickness of the above-described nickel layer is preferably thinner than the surface layer. As a result, self-heating of the binder layer is reduced. According to test results, if the thickness of the nickel binder layer is 0.4 to 1 μm, influence on heating efficiency is suppressed.

Also, equivalent performance can be obtained even when the surface layer is triacetylcellulose (TAC) and diamond-like carbon (DLC) layers or films instead of tin plating. However, tin plating is advantageous in terms of cost compared with them.

Hereinafter, operations of the fixation device 34 will be described. As shown in FIG. 2, in a case of warming up of the fixation device 34, the fixation device 34 rotates the fixation belt 50 in the direction of the arrow u. The IH coil unit 52 generates magnetic flux on the side of the fixation belt 50 by application of a high-frequency current by the inverter drive circuit 68.

For example, in a case of warming up of the fixation device 34, the fixation device 34 rotates the fixation belt 50 in the direction of the arrow u in a state where the fixation belt 50 is separated from the press roller 51. In the case of warming up, the fixation device 34 rotates the fixation belt 50 in the state where the fixation belt is separated from the press roller 51, thereby exerting the following effects. That is, compared with the case where the fixation belt 50 is rotated while abutting the press roller 51, the fixation device 34 can avoid a situation where the heat of the fixation belt 50 is taken by the press roller 51. The fixation device 34 can shorten the warming-up time by avoiding the situation where the heat of the fixation belt 50 is taken by the press roller 51.

Note that, in the case of warming up of the fixation device 34, the fixation belt 50 may be driven and rotated in the direction of the arrow u by rotating the press roller 51 in the direction of the arrow q in the state where the press roller 51 is abutting the fixation belt 50.

As shown in FIG. 4, the IH coil unit 52 heats the fixation belt 50 by the first magnetic paths 81. The heat-generation auxiliary plate 69 assists heating of the fixation belt 50 by the second magnetic paths 82. The rapid warming-up of the fixation belt 50 is facilitated by assisting the heating of the fixation belt 50.

As shown in FIG. 2, the IH control circuit 67 controls the inverter drive circuit 68 according to the measurement results of the temperature of the fixation belt 50 by the center thermistor 61 and the edge thermistor 62. The inverter drive circuit 68 supplies a high-frequency current to the main coils 56.

When the fixation belt 50 reaches a fixation temperature and the warming-up of the fixation device 34 is terminated, the press roller 51 abuts the fixation belt 50. The fixation belt 50 is driven and rotated in the direction of the arrow u by rotating the press roller 51 in the direction of the arrow q in the state where the press roller 51 is abutting the fixation belt 50. Upon receiving a print request, the MFP 10 (see FIG. 1) starts a print operation. The MFP 10 forms a toner image on the sheet P by the printer device 18 and conveys the sheet P to the fixation device 34.

The MFP 10 causes the sheet P, on which the toner image is formed, to pass through the nip 54 between the fixation belt 50, which has reached the fixation temperature, and the press roller 51. The fixation device 34 fixes the toner image to the sheet P. While the fixation is carried out, the IH control circuit 67 controls the IH coil unit 52 and retains the fixation belt 50 at the fixation temperature.

In the above-described fixation operation, the heat of the fixation belt 50 is taken by the sheet P. For example, if the sheets P continuously pass through the fixation belt 50 at high speed, the fixation belt 50 may not be able to retain the fixation temperature since the heat quantity taken by the sheets P is large. The heat-generation auxiliary plate 69 compensates for the deficient heat-generation quantity of the fixation belt 50 by heating assist of the fixation belt 50 by the second magnetic paths 82. The heat-generation auxiliary plate 69 retains the temperature of the fixation belt 50 at the fixation temperature by heating assist of the fixation belt 50 by the second magnetic paths 82 even in the case of high-speed continuous paper feeding.

When the sheet P passes through, at the nip 54, the fixation belt 50 travels while being pressurized by the nip pad 53 and the press roller 51. In this process, the base layer 50*b*, which forms the back surface of the fixation belt 50, is brought into slidable contact with the nip pad 53, is scraped off, and generates abrasion powder. This abrasion powder is mixed with the lubricant oil at the inner periphery of the fixation belt 50, adheres to the periphery thereof, and becomes contamination. If this contamination stays at the slidable contact part at the inner periphery of the fixation belt 50, the rotations (travelling) of the fixation belt 50 is retarded, making it difficult for the fixation belt 50 to travel.

Particularly, since the heat-generation auxiliary plate 69 contacts the fixation belt 50 over a long range in the rotation direction of the fixation belt 50, adherence of the contamination to the outer peripheral surface 69*a* of the heat-generation auxiliary plate 69 (contact surface with the fixation belt 50) largely affects the rotations of the fixation belt 50.

On the other hand, in the present embodiment, the surface layer, which forms the outer peripheral surface 69*a* of the heat-generation auxiliary plate 69, is the tin plating (non-magnetic layer 69*b*). This tin plating (non-magnetic layer 69*b*) can make the above-described contamination hard to adhere and can suppress an increase in the travelling load of the fixation belt 50. Moreover, the surface layer of the tin plating is harder than the base layer 50*b* of the fixation belt 50 and can also suppress abrasion of the surface layer per se. Moreover, since the surface layer of the heat-generation auxiliary plate 69 is the tin plating (non-magnetic layer 69*b*), unlike the case where the surface layer of the heat-generation auxiliary plate 69 is a magnetic layer of, for example, nickel plating, magnetic-path formation in the surface layer is suppressed. Therefore, the surface layer using the tin plating does not affect the heat-generation control utilizing the auxiliary-plate main body 69*c* (magnetic shunt alloy), enables efficient heat generation, and is suitable for the fixation device 34 using the electromagnetic induction heating. Note that, for example, not only the outer peripheral surface 69*a* of the heat-generation auxiliary plate 69, but also the entire surface thereof may be subjected to tin plating.

According to the fixation device 34 of at least one embodiment described above, the outer peripheral surface 69*a* of the heat-generation auxiliary plate 69, which contacts the fixation belt 50, is formed of the non-magnetic layer 69*b* (surface layer) harder than the base layer 50*b*, which forms the inner peripheral surface 50*e* of the fixation belt 50. The non-magnetic layer 69*b* suppresses frictions with the fixation belt 50 and ensures slidability of the fixation belt 50. The non-magnetic layer 69*b* is not easily abraded even when it contacts the fixation belt 50. The non-magnetic layer 69*b* does not easily affect heat generation of the fixation belt 50. Even when abrasion powder is generated, the non-magnetic layer 69*b* is not easily contaminated.

Moreover, the non-magnetic layer 69*b* is formed by plating. The non-magnetic layer 69*b* can be easily formed compared with, for example, coating which requires firing. Moreover, the non-magnetic layer 69*b* is formed of tin or a tin alloy. The non-magnetic layer 69*b* can be easily formed by in-solution plating. Therefore, the non-magnetic layer 69*b* suppresses the cost of surface treatment of the heat-generation auxiliary plate 69.

Meanwhile, the fixation belt 50 and the heat-generation auxiliary plate 69 contact each other via the lubricant oil. The slidability of the fixation belt 50 is more reliably ensured by the lubricant oil.

Meanwhile, the thickness of the non-magnetic layer 69*b* is 1 μm or less. The non-magnetic layer 69*b* suppresses an increase in the distance between the fixation belt 50 and the heat-generation auxiliary plate 69 and suppresses the influence thereof on the electromagnetic-induction heating. Moreover, between the auxiliary-plate main body 69*c* and the non-magnetic layer 69*b*, a binder layer which has the same thickness as the non-magnetic layer 69*b* or is thinner than the non-magnetic layer 69*b* is provided. The binder layer facilitates formation of the non-magnetic layer 69*b*. The binder layer reduces the layer thickness thereof than that of the non-magnetic layer 69*b* to reduce the influence on the electromagnetic-induction heating.

The functions of the fixation device in the above-described embodiment may be realized by a computer. In that case, for example, a program for realizing the functions of the fixation device is recorded in a computer-readable recording medium. The program recorded in the recording medium is read by a computer system. The computer system may realize the functions of the fixation device by executing the program. Note that the "computer system" referred to herein includes hardware such as an OS and peripheral devices. Also, the "computer-readable recording medium" refers to a portable medium such as a flexible disk, a magnetooptical disk, a ROM, or a CD-ROM, or a storage device such as a hard disk built in the computer system. Furthermore, the "computer-readable recording medium" may include one that dynamically retains the program for a short period of time, such as a communication line of a case where the program is transmitted via a network such as the Internet or a communication line such as a phone line. Furthermore, the "computer-readable recording medium" may include one that retains the program for a certain period of time, such as a server in a case where the program is transmitted via a communication line or a volatile memory in a computer system serving as a client. Also, the above-described program may be for realizing part of the above-described functions. Furthermore, the above-described program may be able to realize the above-described functions in combination with a program already recorded in a computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixation device that fixes a toner image formed on a recording medium onto the recording medium, the fixation device comprising:

a fixation belt having a base layer and an electrically-conductive layer formed on the base layer and configured to heat the toner image by generating heat by the electrically-conductive layer in order to fix the toner image onto the recording medium;

a coil opposed to the fixation belt and configured to cause the electrically-conductive layer to generate heat by generating magnetic flux; and a heat-generation auxiliary plate having a magnetic layer and a non-magnetic layer and configured to assist the heating of the recording medium by the fixation belt, the magnetic layer containing a magnetic material and opposed to the coil with the fixation belt interposed therebetween, the non-magnetic layer formed on the magnetic layer, containing a non-magnetic material harder than the base layer of the fixation belt, and contacting the base layer of the fixation belt, wherein the non-magnetic layer of the heat-generation auxiliary plate has a thickness of 1 μm or less.

2. The fixation device according to claim 1, wherein the fixation belt is a tubular endless belt, and the heat-generation auxiliary plate is disposed on an inner peripheral side of the fixation belt.

3. The fixation device according to claim 1, wherein the fixation belt has a protective layer formed on the base layer with the electrically-conductive layer interposed therebetween.

4. The fixation device according to claim 1, wherein the electrically-conductive layer of the fixation belt is a thin layer having a small heat capacity.

5. The fixation device according to claim 1, wherein the heat-generation auxiliary plate is disposed on the fixation belt in a pressed state.

6. The fixation device according to claim 1, wherein the magnetic layer of the heat-generation auxiliary plate is a thin metal member made of a magnetic shunt alloy having a Curie point of 220° C. to 230° C.

7. The fixation device according to claim 1, wherein the coil causes the magnetic layer to generate heat by generating the magnetic flux, and the heat-generation auxiliary plate assists the heating of the recording medium by the fixation belt through the heat generation of the electrically-conductive layer.

8. The fixation device according to claim 1, wherein the non-magnetic layer of the heat-generation auxiliary plate is formed by plating on the magnetic layer.

9. The fixation device according to claim 1, wherein the non-magnetic layer of the heat-generation auxiliary plate contains tin or a tin alloy.

10. The fixation device according to claim 1, wherein the fixation belt and the non-magnetic layer of the heat-generation auxiliary plate contact each other via lubricant oil.

11. The fixation device according to claim 1, wherein, between the magnetic layer and the non-magnetic layer, the heat-generation auxiliary plate has a binder layer having the same thickness as the non-magnetic layer or a thickness smaller than that of the non-magnetic layer.

12. An image formation apparatus comprising:

a supply unit configured to supply a recording medium on which a toner image is formed;

an image formation unit configured to form a toner image on an image carrier;

a transfer unit configured to transfer the toner image formed on the image carrier onto the recording medium; and a fixation device configured to fix the transferred toner image onto the supplied recording medium, wherein the fixation device further has:

a fixation belt having a base layer and an electrically-conductive layer formed above the base layer and configured to heat the toner image by generating heat by the electrically-conductive layer in order to fix the toner image onto the recording medium;

a coil opposed to the fixation belt and configured to cause the electrically-conductive layer to generate heat by generating magnetic flux; and a heat-generation auxiliary plate having a magnetic layer and a non-magnetic layer and configured to assist the heating of the recording medium by the fixation belt, the magnetic layer containing a magnetic material and opposed to the coil with the fixation belt interposed therebetween, the non-magnetic layer formed on the magnetic layer, containing a non-magnetic material harder than the base layer of the fixation belt, and contacting the base layer of the fixation belt, and the non-magnetic layer of the heat-generation auxiliary plate has a thickness of 1 μm or less.

13. The image formation apparatus according to claim 12, wherein the non-magnetic layer of the heat-generation auxiliary plate is formed by plating on the magnetic layer.

14. The image formation apparatus according to claim 12, wherein the non-magnetic layer of the heat-generation auxiliary plate contains tin or a tin alloy.

15. The image formation apparatus according to claim 12, wherein the fixation belt and the non-magnetic layer of the heat-generation auxiliary plate contact each other via lubricant oil.

16. An image formation apparatus comprising:

a supply unit configured to supply a recording medium on which a toner image is formed;

an image formation unit configured to form a toner image on an image carrier;

a transfer unit configured to transfer the toner image formed on the image carrier onto the recording medium; and a fixation device configured to fix the transferred toner image onto the supplied recording medium, wherein the fixation device further has:

a fixation belt having a base layer and an electrically-conductive layer formed above the base layer and configured to heat the toner image by generating heat by the electrically-conductive layer in order to fix the toner image onto the recording medium;

a coil opposed to the fixation belt and configured to cause the electrically-conductive layer to generate heat by generating magnetic flux; and a heat-generation auxiliary plate having a magnetic layer and a non-magnetic layer and configured to assist the heating of the recording medium by the fixation belt, the magnetic layer containing a magnetic material and opposed to the coil with the fixation belt interposed therebetween, the non-magnetic layer formed on the magnetic layer, containing a non-magnetic material harder than the base layer of the fixation belt, and contacting the base layer of the fixation belt, wherein between the magnetic layer and the non-magnetic layer, the heat-generation auxiliary plate has a binder layer having the same thickness as the non-magnetic layer or a thickness smaller than that of the non-magnetic layer.

17. The image forming apparatus according to claim 16, wherein the non-magnetic layer of the heat-generation auxiliary plate is formed by plating on the magnetic layer.

18. The image forming apparatus according to claim 16, wherein the non-magnetic layer of the heat-generation auxiliary plate contains tin or a tin alloy.

19. The image forming apparatus according to claim 16, wherein the fixation belt and the non-magnetic layer of the heat-generation auxiliary plate contact each other via lubricant oil.

* * * * *